US005613273A

United States Patent [19]

Tsai

[11] Patent Number: 5,613,273

[45] Date of Patent: Mar. 25, 1997

[54] RETRACTABLE HANDLE ASSEMBLY OF A SUITCASE TRUCK

[76] Inventor: Cheng-Hsien Tsai, No. 103, Da-Ming 1st Rd., Tien-Tzu, Hsiang, Taichung Hsien, Taiwan

[21] Appl. No.: 538,337

[22] Filed: Oct. 3, 1995

[51] Int. Cl.[6] ..... B25G 1/04

[52] U.S. Cl. ..... 16/115; 190/115

[58] Field of Search ..... 190/115, 18 A; 16/115; 280/654, 655, 47.315, 47.371

[56] References Cited

U.S. PATENT DOCUMENTS

| | | | |
|---|---|---|---|
| 5,414,895 | 5/1995 | Kazmerk, Jr. | 16/115 |
| 5,431,428 | 7/1995 | Marchwiak et al. | 16/115 X |
| 5,438,731 | 8/1995 | Kazmerk, Jr. | 16/115 |
| 5,447,217 | 9/1995 | Chou | 190/115 X |
| 5,488,756 | 2/1996 | Hsieh | 190/18 A X |
| 5,499,426 | 3/1996 | Hsieh | 16/115 |
| 5,502,876 | 4/1996 | Wang | 16/115 |
| 5,515,576 | 5/1996 | Tsai | 16/115 |
| 5,526,908 | 6/1996 | Wang | 190/115 |
| 5,530,990 | 7/1996 | Chen | 16/115 |
| 5,533,601 | 7/1996 | Wang | 16/115 X |

*Primary Examiner*—Allan N. Shoap
*Assistant Examiner*—Christopher J. McDonald
*Attorney, Agent, or Firm*—Bacon & Thomas

[57] ABSTRACT

A retractable handle assembly including a mounting base fixed to a suitcase, two sleeves fixed to the mounting base, two retracting tubes inserted into the sleeves, each retracting tube having a first pin hole and a second pin hole, two locking devices mounted in an opening on the mounting base, each locking device having an outward pin for insertion into the first pin hole of second pin hole of one retracting tube to lock the retracting tubes in the retracted or extended position, a control button, and spring-supported link means connected between the control button and the locking devices, whereby when the control button is moved forwards, the locking devices are pulled inwards by the spring-supported link means to disconnect the respective pins from the first or second pin holes of the retracting tubes for permitting the retracting tubes to be moved between the retracted position and the extended position.

7 Claims, 5 Drawing Sheets

RETRACTABLE HANDLE ASSEMBLY OF A SUITCASE TRUCK

BACKGROUND OF INVENTION

The present invention relates to suitcase trucks, and relates more particularly to the retractable handle assembly of a suitcase truck which comprises a mounting base fixed to a suitcase, two sleeves fixed to the mounting base, two retracting tubes inserted into the sleeves, each retracting tube having a first pin hole and a second pin hole, two locking devices mounted in an opening on the mounting base, each locking device having an outward pin for insertion into the first pin hole of second pin hole of one retracting tube to lock the retracting tubes in the retracted or extended position, a control button, and spring-supported link means connected between the control button and the locking devices, whereby when the control button is moved forwards, the locking devices are pulled inwards by the spring-supported link means to disconnect the respective pins from the first or second pin holes of the retracting tubes for permitting the retracting tubes to be moved between the retracted position and the extended position.

Regular utility trucks are commonly made of metal. These utility trucks are convenient in use for carrying luggage. However these utility trucks need much storage space when they are not used, because they are commonly not collapsible. There is known a suitcase truck having a retractable handle. The retractable handle can be collapsed into a retracted position when it is not in use. This structure of retractable handle comprises a sleeve fixedly secured to the suitcase, a retracting tube slidably inserted into the sleeve, and a springy retainer fixedly secured to retracting tube, the springy retainer having a raised portion forced into one retaining hole of the sleeve to hold the retracting tube in the extended portion or the retracted position. When to move the retracting tube between the extended position and the retracted position, the raised portion of the retainer must be forced inwards from the respective retaining hole on the sleeve. During the operation, the user's fingers tend to be injured.

SUMMARY OF THE INVENTION

According to one aspect of the present invention, the retractable handle assembly comprises a mounting base fixed to a suitcase, two sleeves fixed to the mounting base, two retracting tubes inserted into the sleeves, each retracting tube having a first pin hole and a second pin hole, two locking devices mounted in an opening on the mounting base, each locking device having an outward pin for insertion into the first pin hole of second pin hole of one retracting tube to lock the retracting tubes in the retracted or extended position, a control button, and spring-supported link member connected between the control button and the locking devices. When the control button is moved forwards, the locking devices are pulled inwards by the spring-supported link means to disconnect the respective pins from the first or second pin holes of the retracting tubes for permitting the retracting tubes to be moved between the retracted position and the extended position.

According to another aspect of the present invention, two locating devices are respectively mounted in a respective barrel on the mounting base. Each locating device comprises a center through hole for passing one retracting tube, an upright annular flange raised around said center through hole at one side, and a spring element mounted around the upright annular flange and stopped against an inside wall of the mounting base; each of the retracting tube has an inner end fixedly mounted with an end cap. When the retracting tubes are moved to the extended position and the pins of the locking devices are respectively forced into the second pin holes of the retracting tubes, the end caps of the retracting tubes are stopped at the locating devices, and the spring elements are respectively compressed. When the retracting tubes are released from the locking devices, the spring elements force the locating devices to push the end caps of the retracting tubes backwards to the inside of the sleeves.

DETAILED DESCRIPTION OF THE PREFERRED EMBODIMENT

Figure 1:
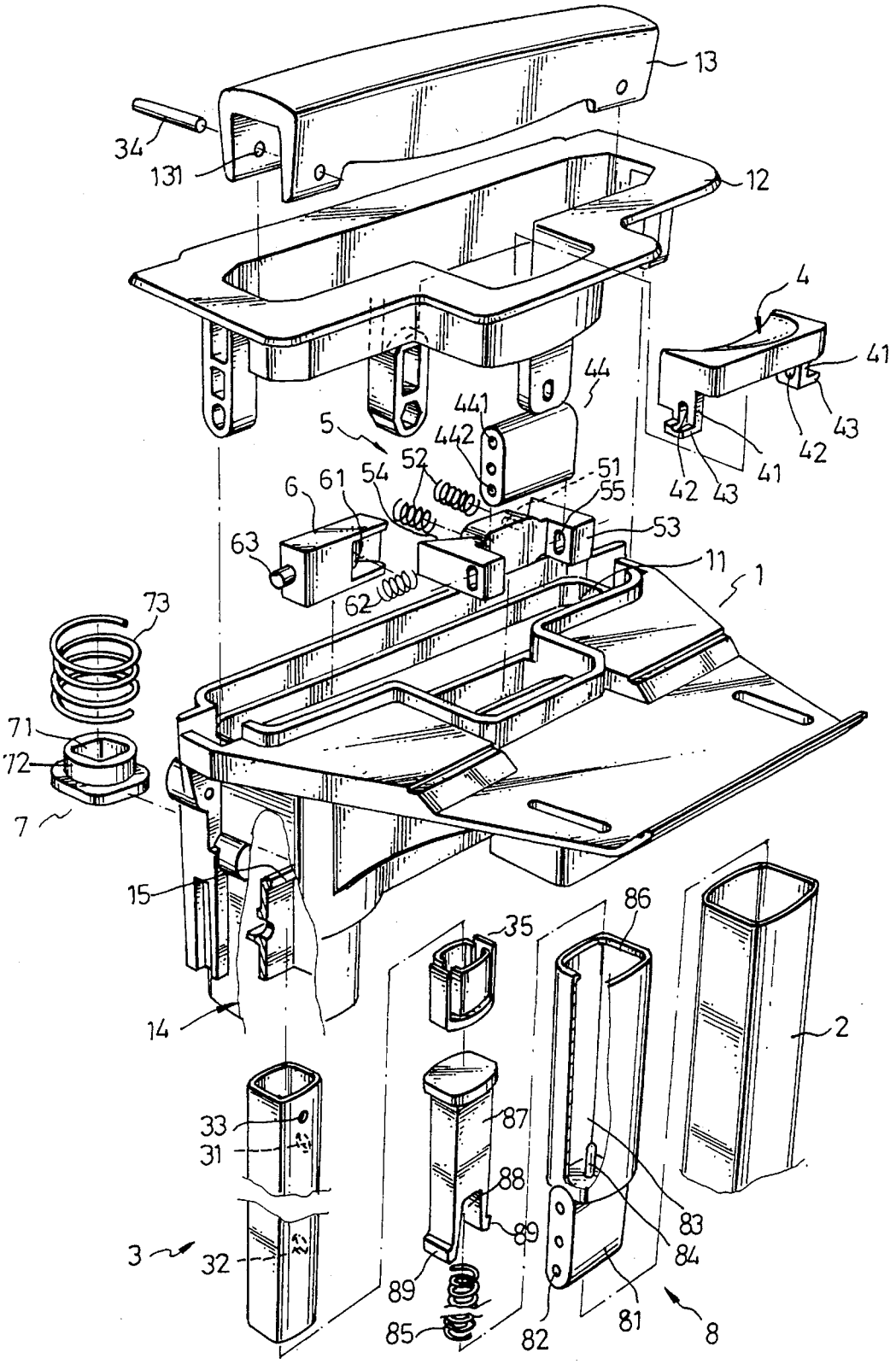
FIG. 1 is an exploded view of the present invention.
Figure 2:
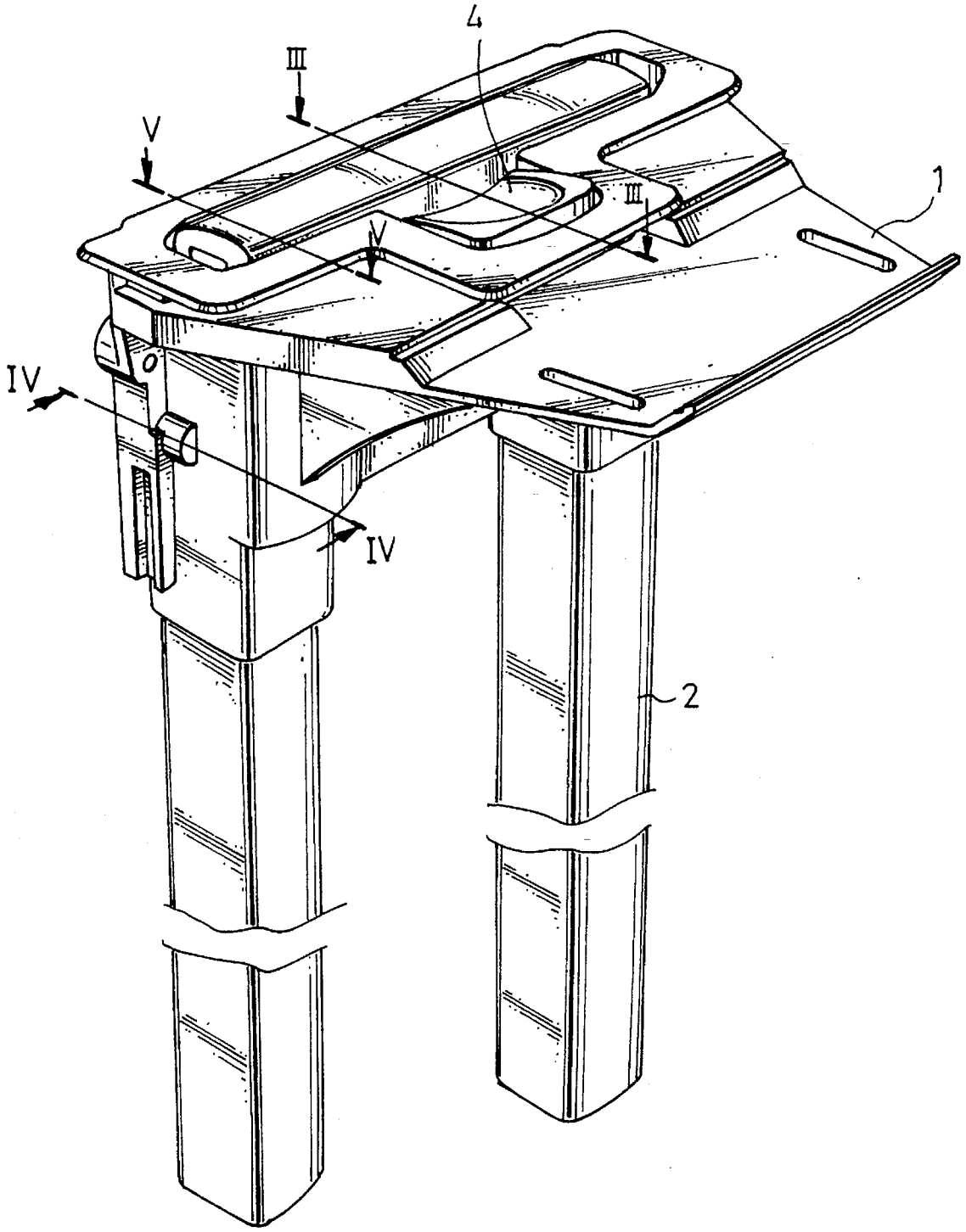
FIG. 2 is an assembly view of the present invention.
Figure 3:
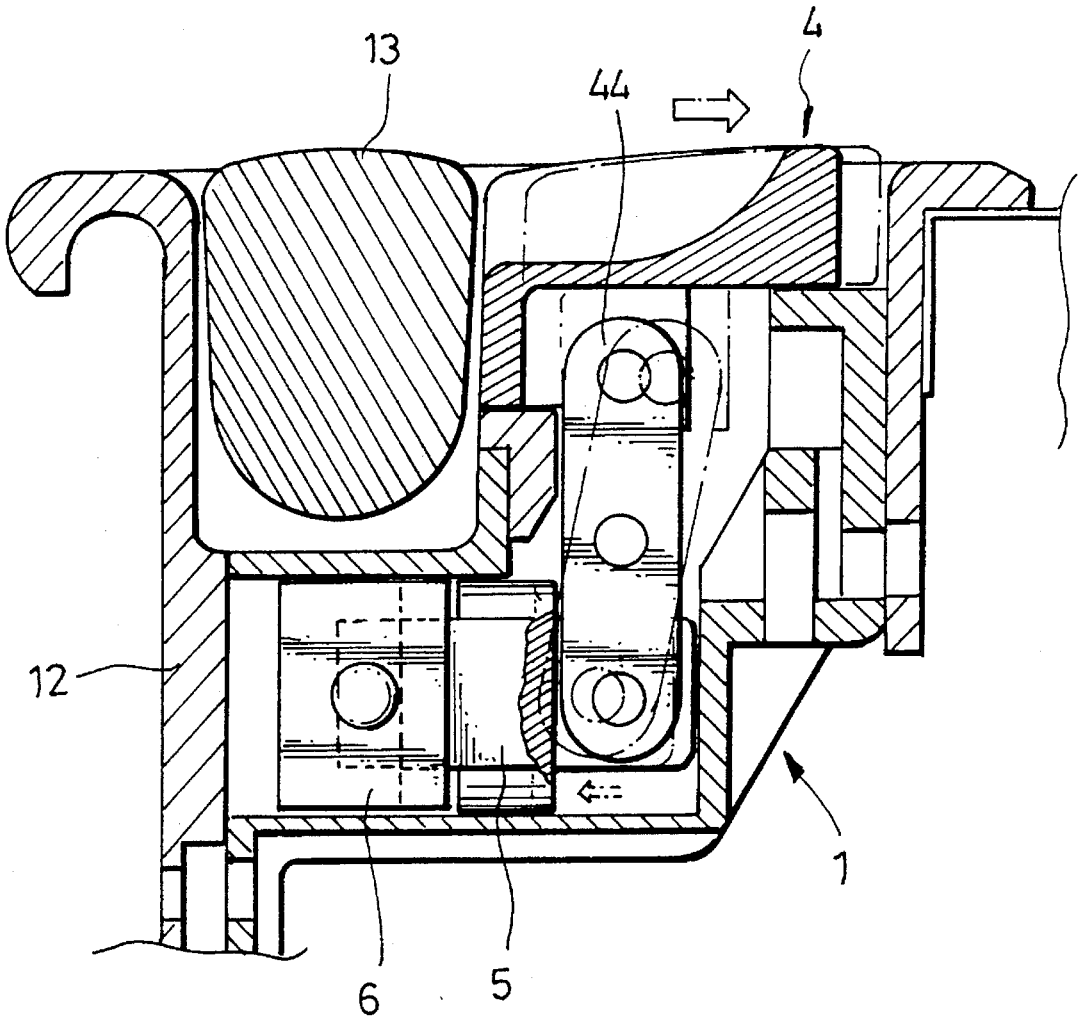
FIG. 3 is a sectional view along line III—III of FIG. 2, showing the control button moved forwards, and the connecting block biased.

Referring to FIGS. 1 and 2, a retractable handle assembly in accordance with the present invention is generally comprised a mounting base 1, two sleeves 2, two retracting tubes 3, a control button 4, a link member 5, two locking device 6, two locating devices 7, two sockets 8, a handgrip 13.

The mounting base 1 is fixedly secured to a suitcase (not shown) 9 at one side remote from the ground, comprising an opening 11, a hollow cap 12 mounted on the opening 11 for receiving the handgrip 13, two barrels 14 perpendicularly downwardly extended from two opposite ends of the opening 11 for receiving the sleeves 2 respectively, and two receiving chambers 15 respectively defined within each barrel 14.

The sleeves 2 are respectively fixedly fastened to the barrels 14 for receiving the retracting tubes 3. The size of the sleeves 2 fits the height of the suitcase 9.

The retracting tubes 3 are respectively slidably inserted into the sleeves 2. Each of the retracting tubes 3 has a pivot hole 33 at one end pivoted to a respective pivot hole 131 at one end of the handgrip 13 by a pivot 34, an end cap 35 at an opposite end, a first pin hole 31 and a second pin hole 32 spaced between the pivot hole 33 and the end cap 35 at an inner side. The diameter of the end cap 35 is bigger than the diameter of the retracting tubes 3.

The control button 4 is mounted inside the opening 11 of the mounting base 1, having two downward lugs 41, two screw holes 42 respectively made on the downward lugs 41, and a connecting block 44 connected between the screw holes 42 of the downward lugs 41. The downward lugs 41 terminate in a respective outward hooked portion 43 hooked at the bottom side of the periphery of the opening 11. The connecting block 44 has two pairs of opposite screw holes at different elevations, namely, the first pair of screw holes 441 connected between the screw holes 42 of the control button 4 by screws, and the second pair o f screw holes 442 for connection to the link member 5.

The link member 5 is connected to the connecting block 44 of the control button 4, comprising at least one projecting rod, for example two projecting rods 51, at least one spring element 52 respectively mounted on each projecting rod 51 and stopped against the peripheral wall of the opening 11 of the mounting base 1, two side boards 53 bilaterally disposed in a parallel relation, two through holes 55 respectively made on the side boards 53 at one end and bilaterally connected to the second screw holes 442 of the connecting block 44 by screws, and two inwardly beveled edge 54 respectively made on the side boards 53 at an opposite end for insertion into a hole 61 on one locking device 6.

The locking devices 6 are respectively coupled to the link member 5 at two opposite sides, each having a pin 63 at one end for insertion into the first pin hole 31 or second pin hole 32 of one retracting tube 3, a recessed hole 61 at an opposite end, and a spring element 62 mounted inside the recessed hole 61 and stopped against one side of the link member 5.

The locating devices 7 are respectively mounted inside the receiving chamber 15 of each barrel 14, each having a center through hole 71 for passing one retracting tube 3, an upright annular flange 72 raised around the center through hole 71 at one side to hold a spring element 73. The spring element 73 is mounted around the upright annular flange 72 on one locating device 7 and stopped against the inside wall of the mounting base 1.

The sockets 8 are respectively mounted in one end of each sleeve 2 remote from the mounting base 1. Each of the sockets comprises a mounting portion 81 at one end having a plurality of mounting holes 82 respectively fastened to the suitcase (not shown) by screws, a receiving chamber 83 at an opposite end, an inward flange 86 around the orifice of the receiving chamber 83, an inside post 84 inside the receiving chamber 83, a spring element 85 mounted around the inside post 84, a bearing element 87 inserted into the receiving chamber 83 and stopped between the spring element 85 and the end cap 35 of one retracting tube 3. The bearing element 87 has one end projecting out of the receiving chamber 83 of the respective sockets 8 and stopped against the end cap 35 of one retracting tube 3,and an opposite end terminating in two outward hooks 89 and an opening 88 between the outward hooks 89. The spring element 85 is mounted around the inside post 84 and received in the opening 88 to give an upward pressure to the bearing element 87, causing the outward hooks 89 of the bearing element 87 to hook at the bottom side of the inward flange 86.

Figure 4A:
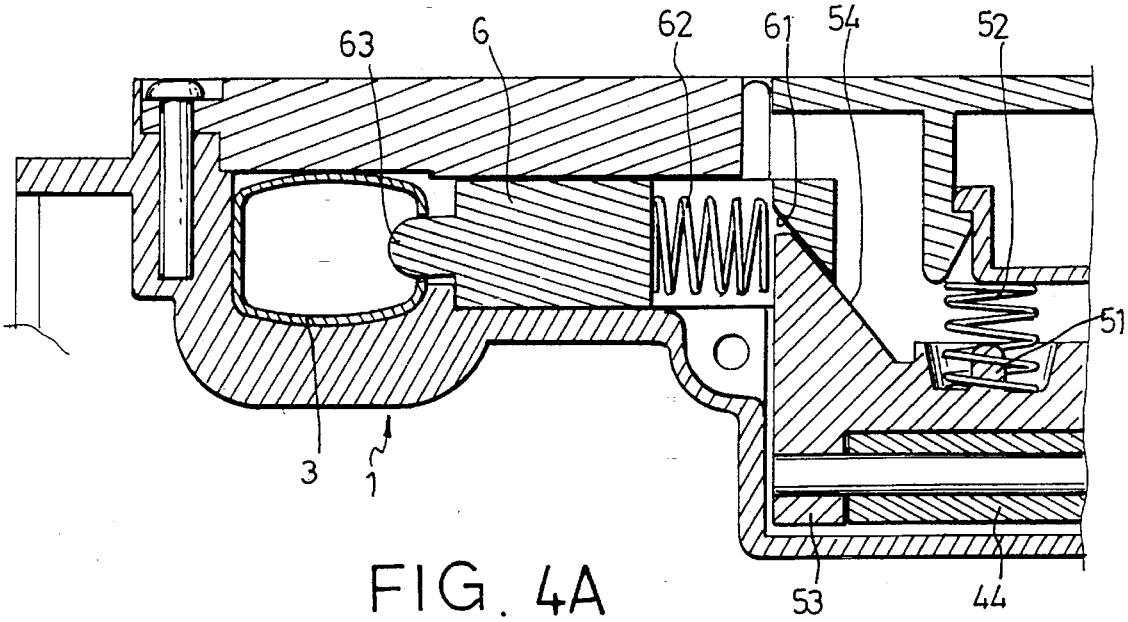
FIG. 4A is a sectional view along line IV—IV of FIG. 2.
Figure 4B:
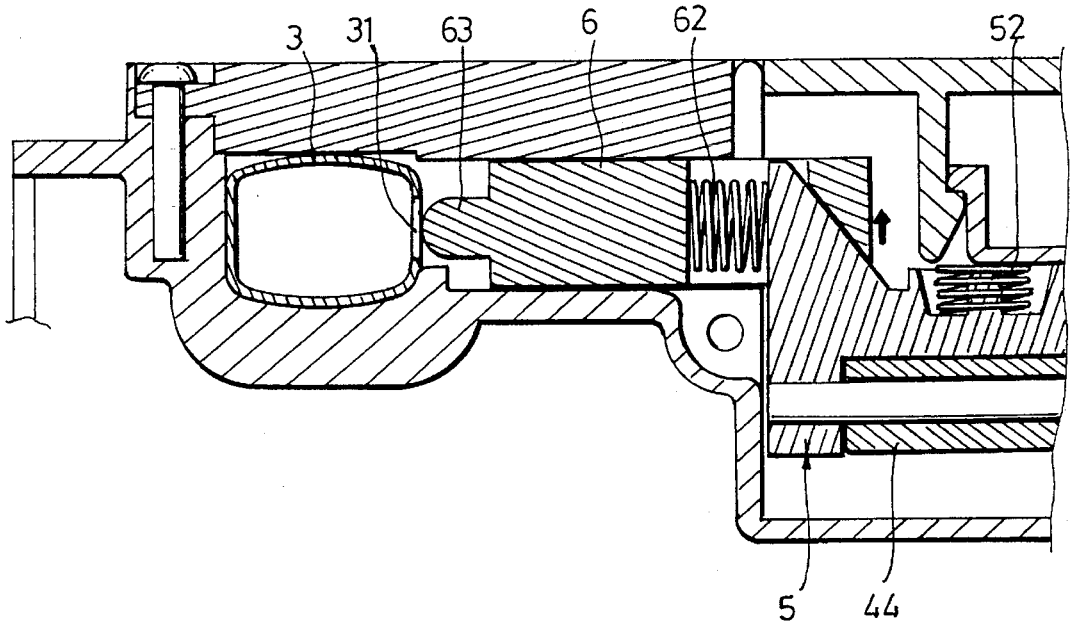
FIG. 4B is similar to FIG. 4A but showing the pin of the locking device disconnected from the first pin hole of the respective retracting tube.
Figure 5:
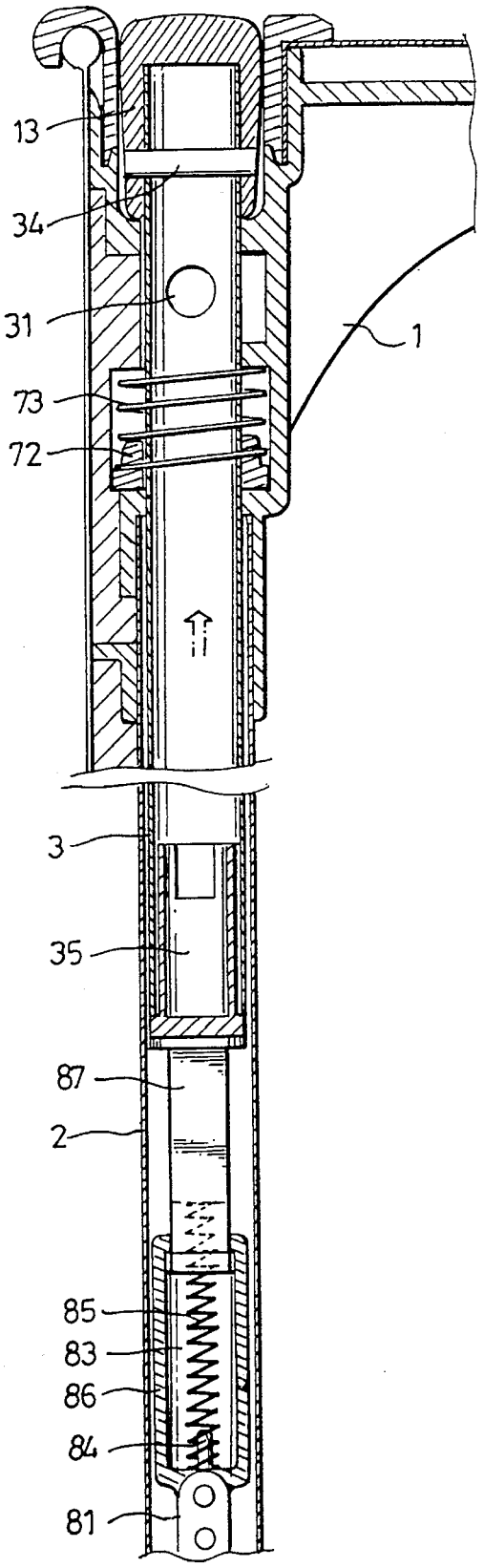
FIG. 5 is a sectional view along line V—V of FIG. 2.

Referring to FIGS. 3, 4A, 4B, and 5, when in use, the control button 4 is pushed forwards to bias the connecting block 44 (see FIG. 3), causing the link member 5 to pull the locking devices 6 inwards, and therefore the pin 63 of each locking device 6 is disconnected from the first pin hole 31 of the respective retracting tube 3 (see FIGS. 4A and 4B). When the pins 63 of the locking devices 6 are respectively disconnected from the first pin holes 31 of the retracting tubes 3, the bearing elements 87 of the sockets 8 are forced outwards by the respective spring elements 85 to push the retracting tubes 3 outwards, and therefore the retracting tubes 3 can be pulled from the retracted (non-operative) position to the extended (operative) position by the handgrip 13. When the retracting tubes 3 are pulled out of the mounting base 1, the end caps 35 of the retracting tubes 3 are respectively stopped at the locating devices 7, the spring elements 73 are simultaneously compressed, and the pins 63 of the locking devices 6 are forced by the spring force of the spring elements 62 into the second pin holes 32 (see FIG. 5), and therefore the retracting tubes 3 are locked in the extended (operative) position, When the retracting tubes 3 are locked in the extended position, the link member 5 is forced by the spring elements 52 to move the connecting block 4 and the control button 4 to their former positions. On the contrary, when to move the retracting tubes 3 back from the extended (operative) position to the retracted (non-operative) position, the control button 4 is moved forwards again to bias the connecting block 4, causing the link member 5 to pull the locking devices 6 inwards, and therefore the pins 63 of the locking devices 6 are respectively disconnected from the second pin holes 31 of the retracting tubes 3 for permitting the retracting tubes 3 to be moved back inside the sleeves 2, When the retracting tubes 3 are moved from the extended (operative) position to the retracted (non-operative) position, the pins 63 of the locking devices 6 are respectively forced into the first pin holes 31 of the retracting tubes 3, and the bearing elements 87 are respectively forced into the sockets 8.

While only one embodiment of the present invention has been shown and described, it will be understood that various modifications and changes could be made without departing from the spirit and scope of the invention disclosed. For example, the number of screw holes of the connecting block 44 can be more than two pairs; the retracting tubes 3 may be made telescopic, each consisting of a plurality of sections that slide one inside another; the spring elements 52, 63, 73, 85 can be compression springs or spring plates.

I claim:

1. A retractable handle assembly comprising:

a mounting base fixedly secured to a suitcase at one side, said mounting base comprising an opening, two barrels perpendicularly downwardly extended from two opposite ends of said opening and two receiving chambers respectively defined within each barrel;

two sleeves respectively fixedly fastened to said barrels for receiving two retracting tubes respectively;

a handgrip received in the opening of said mounting base;

two retracting tubes respectively connected to two opposite ends of said handgrip in a parallel relation and respectively slidably inserted into said sleeves, each retracting tube having a fixed end connected to one end of said handgrip, a free end fixedly mounted with a respective end cap and slidably moved in one sleeve, a first pin hole adjacent to said fixed end, and a second pin hole adjacent to the respective end cap;

a control button movably disposed inside the opening of said mounting base, having two downward lugs at two opposite ends and a connecting block connected between said two downward lugs;

link means connected to said connecting block comprising at least one projecting rod, at least one spring element respectively mounted on each projecting rod and stopped against the peripheral wall of the opening of said mounting base, and two side boards respectively connected to two opposite ends of said connecting block, each side board having an inwardly beveled edge at one end inserted into a hole on a respective locking device;

two locking devices respectively coupled to said link means at two opposite sides, each locking device comprising a pin at one end for insertion into the first pin hole of one retracting tube to lock said retracting tube in a retracted position, or into the second pin hole of one retracting tube to lock said retracting tube in an extended position, a recessed hole at an opposite end, and a spring element mounted inside said recessed hole and stopped against a side board of said link means;

two locating devices respectively mounted inside the receiving chamber of each barrel, each locating device comprising a center through hole for passing one retracting tube, an upright annular flange raised around said center through hole at one side, and a spring element mounted around said upright annular flange and stopped against an inside wall of said mounting base; and two sockets respectively mounted in one end of each sleeve remote from said mounting base, each socket comprising a mounting portion at one end fixedly secured to said suitcase, a receiving chamber at an opposite end, said receiving chamber having an orifice, an inward flange around the orifice of said receiving chamber, an inside post inside the receiving chamber of the respective sockets, a spring element mounted around said inside post, a bearing element inserted into the receiving chamber of the respective sockets and stopped between the spring element inside the respective sockets and the end cap of one retracting tube;

whereby when said control button is moved forwards, said locking devices are pulled inwards by said link means to disconnect the respective pins from the first or second pin holes of said retracting tubes for permitting said retracting tubes to be moved between said retracted position and said extended position.

2. The retractable handle assembly of claim 1 further comprising a hollow cap mounted on the opening of said mounting base.

3. The retractable handle assembly of claim 1 wherein said handgrip has two pivot holes at two opposite ends, said retracting tubes have a respective pivot hole at one end respectively connected to one pivot hole of said handgrip by a respective pivot.

4. The retractable handle assembly of claim 1 wherein the downward lugs of said control button have a respective screw hole, the side boards of said link means have a respective screw hole at one end remote from the respective inwardly beveled edge, and said connecting block has a first pair of screw holes at one end respectively connected to the screw holes of the downward lugs of said control button by respective screws, and a second pair of screw holes at an opposite end respectively connected to the screw holes of the side boards of said link means by respective screws.

5. The retractable handle assembly of claim 1 wherein said connecting block has a plurality of screw holes respectively connected to the downward lugs of said control button and the side boards of said link means by respective screws.

6. The retractable handle assembly of claim 1 wherein the mounting portion of each of said sockets has at least one mounting hole respectively fastened to said suitcase by a respective screw.

7. The retractable handle assembly of claim 1 wherein the bearing element of each of said sockets has one end projecting out of the receiving chamber of the respective sockets and stopped against the end cap of one retracting tube, and an opposite end terminating in two outward hooks and an opening between the outward hooks, the opening of the bearing element of each of said sockets receiving the respective spring element inside the respective socket means, the outward hooks of the bearing element of each of said sockets being forced by the respective spring element to hook on the inward flange of the respective sockets.

* * * * *